US006851630B2

(12) United States Patent
Nagaoka et al.

(10) Patent No.: US 6,851,630 B2
(45) Date of Patent: Feb. 8, 2005

(54) ELECTROMAGNETIC FUEL INJECTION VALVE

(75) Inventors: Takahiro Nagaoka, Miyagi (JP); Hideyuki Watanabe, Miyagi (JP); Shinya Ichise, Miyagi (JP)

(73) Assignee: Keihin Corporation, Tokyo (JP)

( * ) Notice: Subject to any disclaimer, the term of this patent is extended or adjusted under 35 U.S.C. 154(b) by 12 days.

(21) Appl. No.: 10/339,650

(22) Filed: Jan. 10, 2003

(65) Prior Publication Data

US 2003/0230649 A1 Dec. 18, 2003

(30) Foreign Application Priority Data

Jan. 17, 2002 (JP) ..... 2002-008737

(51) Int. Cl.[7] ..... B05B 1/30; F02M 51/00

(52) U.S. Cl. ..... 239/585.1; 239/533.2; 239/533.11; 239/533.12; 239/585.2; 239/585.3; 239/585.4; 239/585.5

(58) Field of Search ..... 239/533.2, 533.11, 239/583, 584, 585.1, 585.2, 585.3, 585.4, 585.5, 900, 533.12

(56) References Cited

U.S. PATENT DOCUMENTS 5,348,232 A * 9/1994 Babitzka et al. ..... 239/585.4
6,098,655 A * 8/2000 Bloch et al. ..... 137/488
6,508,416 B1 * 1/2003 Mastro et al. ..... 239/585.1
6,656,293 B2 * 12/2003 Black et al. ..... 148/219
6,715,693 B1 * 4/2004 Dam et al. ..... 239/585.1
2003/0198417 A1 * 10/2003 Yamamoto et al. ..... 384/492
2004/0038033 A1 * 2/2004 Massler et al. ..... 428/408

FOREIGN PATENT DOCUMENTS

JP 11-22585 1/1999

* cited by examiner

*Primary Examiner*—Robin O. Evans
(74) *Attorney, Agent, or Firm*—Arent Fox PLLC

(57) ABSTRACT

An electromagnetic fuel injection valve includes a valve housing coupled to at one end thereof to a valve seat member; a stationary core coupled to the other end of the valve housing; and a valve assembly comprised of a movable core slidably accommodated in the valve housing, and a valve member connected to the movable core through a rod portion and adapted to cooperate with the valve seat. In the electromagnetic fuel injection valve, the valve housing is provided with a guide portion on which the valve assembly is axially slidably carried, and a high-hardness coating of diamond-like carbon including silicon is formed on an outer peripheral surface of the valve assembly contacting with the guide portion. The surface roughness Rmax of the high-hardness coating is set in a range of 0.05 to 0.2 $\mu$m. Thus, it is possible to achieve the stabilization of opened and closed attitudes of the valve assembly and the responsiveness of the valve assembly, thereby contributing an improvement in low fuel consumption in an engine.

1 Claim, 4 Drawing Sheets

ELECTROMAGNETIC FUEL INJECTION VALVE

BACKGROUND OF THE INVENTION

1. Field of the Invention

The present invention relates to an electromagnetic fuel injection valve mainly used in a fuel supply system for an internal combustion engine, and particularly to an improvement in an electromagnetic fuel injection valve including: a valve seat member having a valve seat at one end; a valve housing coupled at one end thereof to the other end of the valve seat member; a stationary core coupled to the other end of the valve housing; and a valve assembly comprised of a movable core slidably accommodated in the valve housing so that it is opposed to the stationary core, and a valve member connected to the movable core through a rod portion and adapted to cooperate with the valve seat, the valve housing being provided with a guide portion on which the valve assembly is axially slidably carried, the valve assembly having a high-hardness coating formed on its outer peripheral surface contacting the guide portion to provide a wear resistance.

2. Description of the Related Art

In a conventional electromagnetic fuel injection valve, it is already known that a high-hardness coating is formed on an outer peripheral surface of a movable core by hard chromium plating or titanium coating, as disclosed in, for example, Japanese Patent Application Laid-open No. 11-22585.

When the high-hardness coating is formed on the outer peripheral surface of the movable core by hard chromium plating or titanium coating, in minimizing the surface roughness of the coating, the surface roughness Rmax is conventionally limited to about 2 $\mu$m.

In the conventional electromagnetic fuel injection valve, when the sliding gap between the valve assembly and the guide portion is minimized with their dimensional accuracies enhanced in order to stabilize the opened and closed attitudes of the valve assembly to enhance the accuracy of injection amount of fuel, if the surface roughness R max of the high-hardness coating formed on the valve assembly is about 2 $\mu$m, the sliding resistance is increased to bring about a reduction in responsiveness of the valve assembly and an increase in power consumption. Moreover, the wear of the coating advances over a long period, and as a result the opened and closed attitudes of the valve assembly become unstable to exert an adverse effect to the accuracy of the injection amount of fuel. Thus, the performance and the durability of the electromagnetic fuel injection valve cannot be satisfied.

SUMMARY OF THE INVENTION

Accordingly, it is an object of the present invention to provide a an electromagnetic fuel injection valve, in which even if the sliding gap between the movable core and the guide portion for the movable core is minimized with their dimensional accuracies enhanced, an increase in sliding resistance cannot be brought about, and hence the valve assembly is excellent in stabilization of the opened and closed attitudes and in responsiveness, which can contribute to an improvement in low fuel consumption in an engine.

To achieve the above object, according to a first feature of the present invention, there is provided an electromagnetic fuel injection valve including: a valve seat member having a valve seat at one end; a valve housing coupled at one end thereof to the other end of the valve seat member; a stationary core coupled to the other end of the valve housing; and a valve assembly comprised of a movable core slidably accommodated in the valve housing so that it is opposed to the stationary core; and a valve member connected to the movable core through a rod portion and adapted to cooperate with the valve seat, the valve housing being provided with a guide portion on which the valve assembly is axially slidably carried, the valve assembly having a high-hardness coating formed on its outer peripheral surface contacting with the guide portion, wherein the high-hardness coating is formed by depositing diamond-like carbon on the outer peripheral surface of the valve assembly by an ion plating using an organic gas as a starting material.

With the first feature, the surface roughness Rmax of the high-hardness coating formed on the outer peripheral surface of the valve assembly can be set at an extremely small value in a range of 0.05 to 0.2 $\mu$m; the sliding gap between the movable core and the guide portion for the movable core can be minimized with their dimensional accuracies enhanced without bringing about an increase in sliding resistance; and both the stabilization of the opened and closed attitudes and the responsiveness of the valve assembly can be established, thereby contributing to an improvement in low fuel consumption in an engine.

Moreover, the diamond-like carbon forming the high-hardness coating has a frictional coefficient smaller than that of a high-hardness coating formed by chromium plating, whereby an increase in sliding resistance of the valve assembly can be effectively suppressed.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of a preferred embodiment with reference to the accompanying drawings.

Figure 1:
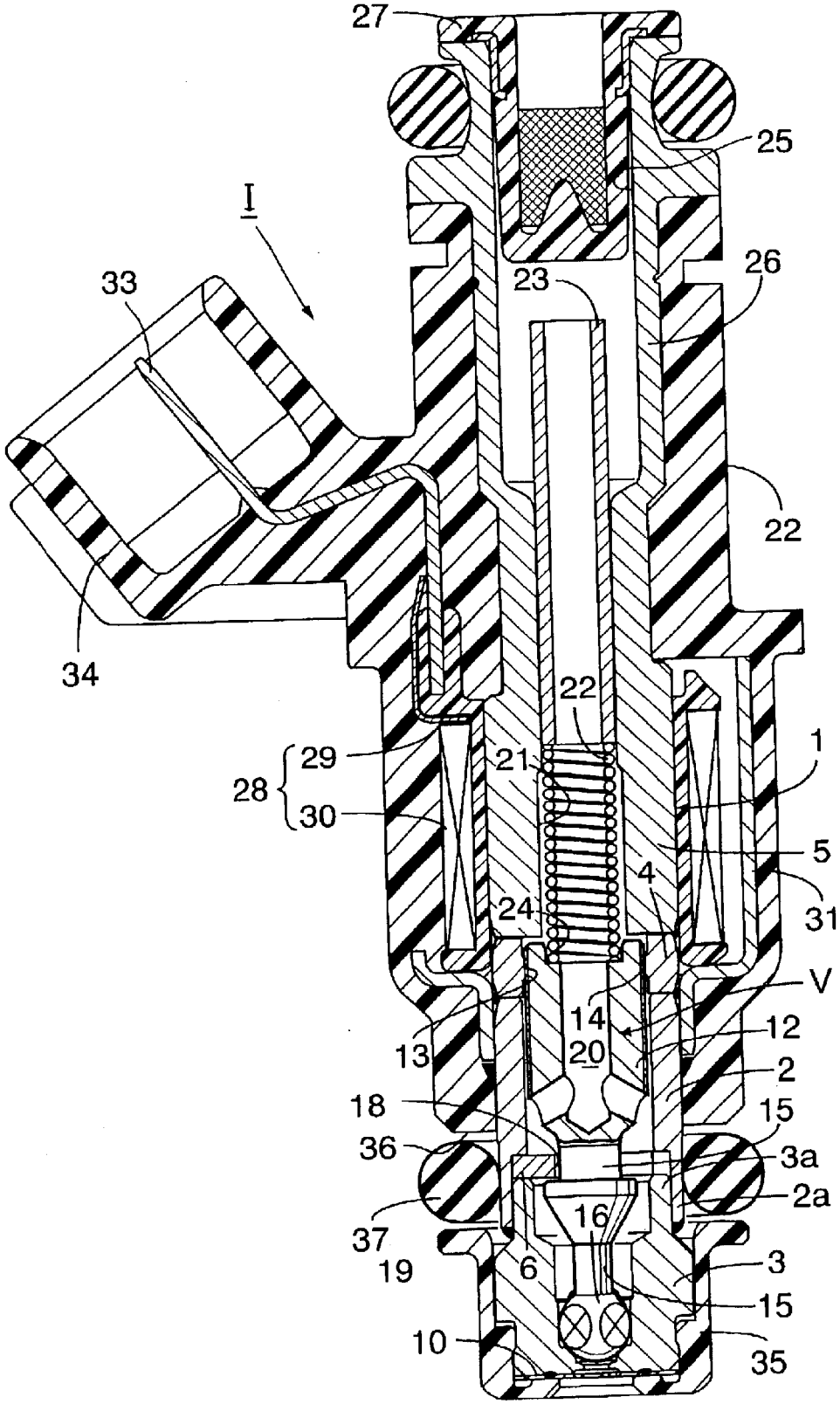
FIG. 1 is a vertical sectional view of an electromagnetic fuel injection valve for an internal combustion engine according to a first embodiment of the present invention.
Figure 2:
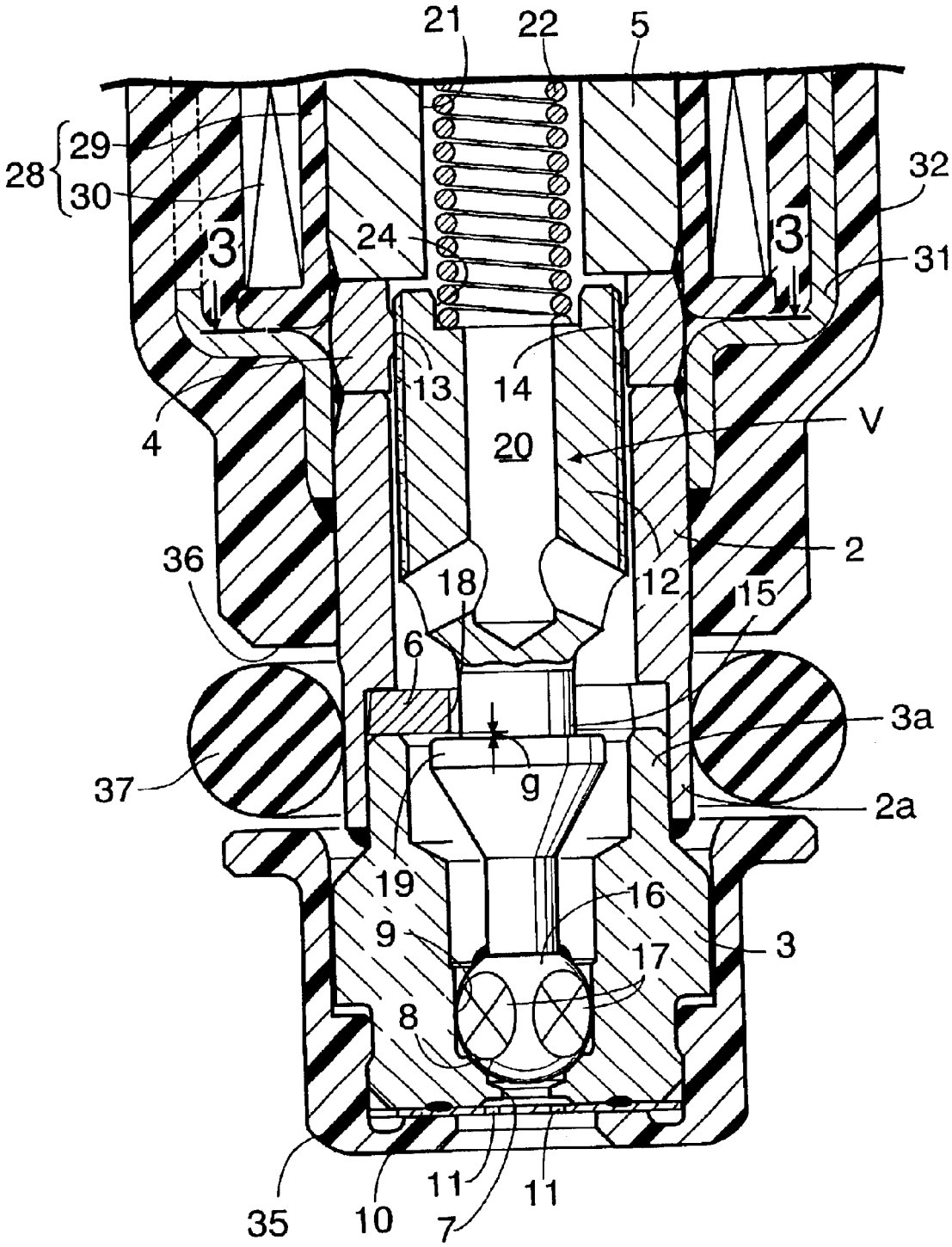
FIG. 2 is an enlarged view of essential portions of FIG. 1.
Figure 3:
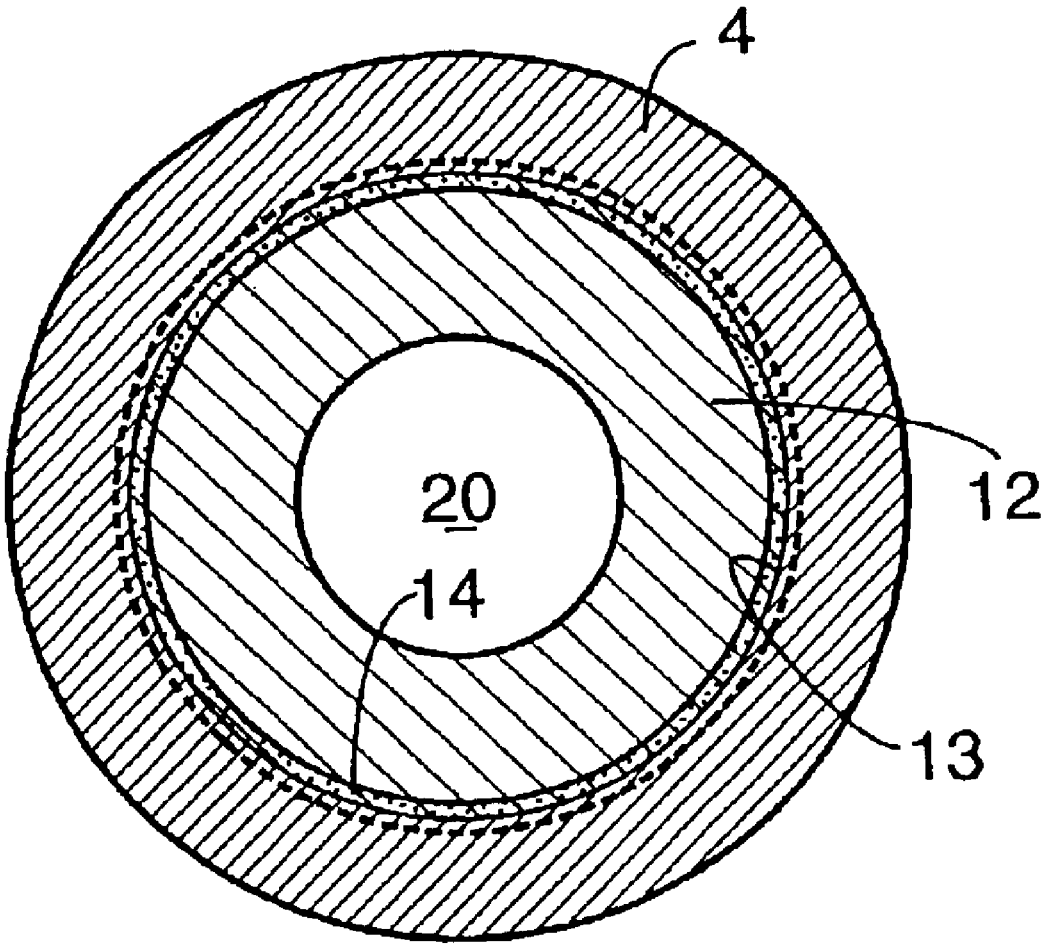
FIG. 3 is a sectional view taken along a line 3—3 in FIG. 2.

Referring to FIGS. 1 and 2, a casing 1 of an electromagnetic fuel injection valve I for an internal combustion engine is comprised of a cylindrical valve housing 2 (made of a magnetic material), a bottomed cylindrical valve seat member 3 liquid-tightly coupled to a front end of the valve housing 2, and a cylindrical stationary core 5 liquid-tightly coupled to a rear end of the valve housing 2 with an annular spacer 4 interposed therebetween.

The annular spacer 4 made of a non-magnetic metal, e.g., a stainless steel, and the valve housing 2 and the stationary core 5 are placed to abut against opposite end faces of the annular spacer 4, and liquid-tightly welded to the opposite end faces over their entire peripheries.

A first fitting tube portion 3*a* and a second fitting tube portion 2*a* are formed at opposed ends of the valve seat member 3 and the valve housing 2, respectively. The first fitting tube portion 3*a* is press-fitted along with a stopper plate 6 into the second fitting tube portion 2*a*. The stopper plate 6 is clamped between the valve housing 2 and the valve seat member 3. Thereafter, laser welding or beam welding is conducted over the entire periphery of a corner sandwiched between an outer peripheral surface of the first fitting tube portion 3*a* and an end face of the second fitting tube portion 2*a*, whereby the valve housing 2 and the valve seat member 3 are liquid-tightly coupled to each other.

The valve seat member 3 includes a valve bore 7 which opens into a front end face of the valve set member 3, a conical valve seat 8 leading to an inner end of the valve bore 7, and a cylindrical guide bore 9 leading to a larger-diameter portion of the valve seat 8. The guide bore 9 is formed coaxially with the second fitting tube portion 2*a*.

An injector plate 10 made of a steel plate is liquid-tightly welded to the front end face of the valve seat member 3 over the entire periphery, and has a plurality of fuel injection bores 11 communicating with the valve bore 7.

A movable core 12 is accommodated in the valve housing and the annular spacer 4, and is opposed to a front end face of the stationary core 5. An annular guide surface 13 is projectingly provided on an inner peripheral surface of the annular spacer 4, so that the movable core 12 is axially slidably carried on the annular guide surface 13. A high-hardness coating 14 of diamond-like carbon is formed on an outer peripheral surface of the movable core 12 contacting with the guide surface 13 in order to reduce the sliding resistance to the guide surface 13 of the movable core 12. The high-hardness coating 14 of diamond-like carbon is formed by ion plating using an organic gas as a starting material, thereby ensuring that the surface roughness Rmax of the high-hardness coating 14 is in a range of 0.05 to 0.2 $\mu$m. The reason why the extremely small surface roughness is obtained as described above is that particles in the coating are extremely small, because the starting material used in the ion plating is the organic gas.

The movable core 12 is integrally provided with a smaller-diameter rod portion 15 extending from one end face thereof toward the valve seat 8. A spherical valve member 16 capable of seating on the valve seat 8 is secured to a tip end of the rod portion 15 by welding. Thus, a valve assembly V is constituted by the movable core 12, the rod portion 15 and the valve member 16.

The valve member 16 is axially slidably carried in the guide bore 9. A plurality of chamfers 17 enabling the flowing of a fuel within the guide bore 9 are formed at equal intervals on an outer peripheral surface of the valve member 16.

The stopper plate 6 is provided with a notch 18 through which the rod portion 15 extends, and has a stopper flange 19 formed at a location corresponding to the middle of the rod portion 15, the stopper flange 19 being opposed to an end face on the side of the valve seat 8. A gap is provided between the stopper plate 6 and the stopper flange 19, and corresponds to an opening stroke of the valve member 16, when the valve member 16 is closed, i.e., seated on the valve seat 8.

On the other hand, a gap is provided between the stationary core 5 and the movable core 12, the gap being large enough to avoid the abutment of the stationary and movable cores 5 and 12 against each other even upon closing of the valve member 16, i.e., upon seating of the valve member 16 on the valve seat 8.

The stationary core 5 has a hollow 21 communicating with the inside of the valve housing 2 through a through-bore 20 in the movable core 12. Accommodated in the hollow 21 are a coiled valve spring 22 for biasing the movable core 12 in a direction to close the valve member 16, i.e., in a direction to cause the valve member 16 to seat on the valve seat 8, and a pipe-shaped retainer 23 which supports a rear end of the valve spring 22.

In this case, a positioning recess 24 for accommodating a front end of the valve spring 22 is defined at a rear end face of the movable core 12. The preset load of the valve spring 22 is adjusted by the insertion depth of press-fitting of the retainer 23 into the hollow 21.

An inlet tube 26 is integrally connected to a rear end of the stationary core 5, and has a fuel inlet 25 communicating with the hollow 21 in the stationary core 5 through the pipe-shaped retainer 23. A fuel filter 27 is mounted in the fuel inlet 25.

A coil assembly 28 is mounting around outer peripheries of the annular space 4 and the stationary core 5. The coil assembly 28 comprises a bobbin 29 fitted over outer peripheral surfaces of the annular spacer 4 and the stationary core 5, and a coil 30 wound around the bobbin 29. A coil housing 31 surrounding the coil assembly 28 is coupled at one end thereof to an outer peripheral surface of the valve housing 2 by welding.

The coil housing 31, the coil assembly 28 and the stationary core 5 are embedded in a cover 32 made of a synthetic resin. A coupler 34 has a connecting terminal 33 accommodated therein and leading to the coil 30, and is integrally connected to an intermediate portion of the cover 32.

An annular groove 36 is defined between the front end face of the cover 32 and a synthetic resin cap 35 fitted over a front end of the valve seat member 3. An O-ring 37 is mounted in the annular groove 36 to come into close contact with the outer peripheral surface of the valve housing 2, so that when the electromagnetic fuel injection valve I is mounted into a fuel injection valve-mounting bore in an intake manifold (not shown), the O-ring 37 is brought into close contact with an inner peripheral surface of the fuel injection valve-mounting bore.

The operation of the first embodiment will be described below.

As shown in FIG. 2, in a state in which the coil 30 has been deexcited, the movable core 12 and the valve member 16 are urged forwards by a biasing force of the valve spring 22, whereby the valve member 16 is seated on the valve seat 8. Therefore, a high-pressure fuel supplied into the valve housing 2 through the fuel filter 27 and the inlet tube 26 is at standby within the valve housing 2.

When the coil 30 is excited by supplying an electric current, a magnetic flux produced by such excitement runs sequentially through the stationary core 5, the coil housing 31, the valve housing 2 and the movable core 12, so that the movable core 12 of the valve assembly V is attracted along with the valve member 16 to the stationary core 5 by a magnetic force of the magnetic flux, whereby the valve seat 8 is opened. Therefore, the high-pressure fuel in the valve housing 2 is passed through the valve bore 7 via the chamfers 17 of the valve member 16 and injected from the fuel injection bores 11 toward an intake valve of an engine. At this time, the limit of opening of the valve assembly V is defined by abutment of the stopper flange 19 of the valve assembly V against the stopper plate 6 secured to the valve housing 2.

During operation of such electromagnetic fuel injection valve I, the opened and closed attitudes of the valve assembly V are always correctly maintained without being inclined, in such a manner that opposite ends of the valve assembly V are supported by the guide surface 13 of the annular spacer 4 and the guide bore 9 in the valve seat member 3. Therefore, it is possible to avoid a fluctuation in opening amount of the valve assembly V d, i.e., in injection amount of fuel, thereby stabilizing the injection characteristic.

Moreover, even if the sliding gap between the annular spacer 4 and the valve assembly V is minimized, the high-hardness coating 14 formed on the outer peripheral surface of the movable core 12 and having the surface roughness Rmax in the range of 0.05 to 0.2 $\mu$m provides a reduction in sliding resistance to the guide surface 13 of the valve assembly V, and as a result the lowest operating voltage is dropped. Thus, even when the voltage changes, a high responsiveness of the valve assembly V can be ensured.

Figure 4:
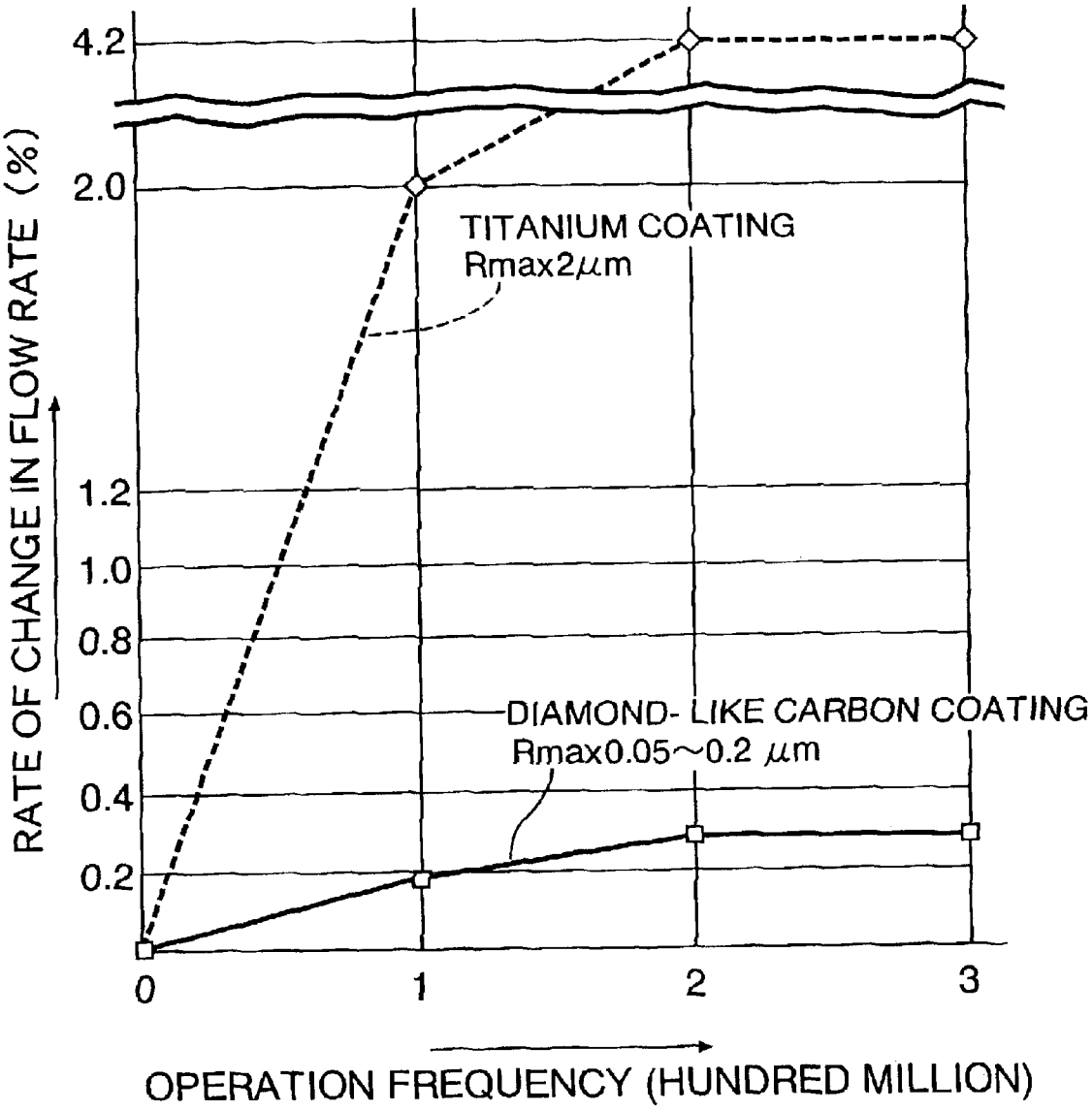
FIG. 4 is a graph showing results of a comparison test for a rate of change in amount of fuel injected.

A comparison test was actually carried out using a conventional movable core having a coating formed by titanium coating and having a surface roughness Rmax of 2 $\mu$m and the movable core 12 in the present invention having the coating 14 of diamond-like carbon having the surface roughness Rmax in the range of 0.05 to 0.2 $\mu$m. The result showed that the lowest operating voltage was 5.26 V in the case of the conventional movable core, but the lowest operating voltage was remarkably improved to 4.87 V in the case of the movable core 12 in the present invention. In addition, as for a rate of change in the injection amount of fuel, it was observed that the changing rate was steeply increased with an increase in opening/closing frequency in the prior art, but the changing rate was extremely low in the present invention, as shown in a graph in FIG. 4.

Especially, when the high-hardness coating 14 is formed of diamond-like carbon, because the frictional coefficient thereof is small as compared with that of a coating formed by chromium plating, the sliding resistance to the guide surface 13 of the valve assembly V can be further reduced and an enhancement in wear resistance can be provided.

According to the present invention, the high-hardness coating 14 may be formed on any portion of the valve assembly V without being limited on the movable core 12, if such portion is guided to the valve housing 2 or a portion or member fixed to the valve housing 2. Especially, if the high-hardness coating 14 is formed on the movable core 14 as described above, the axial movement of an end of the movable core 12 which is a heaviest portion in the valve assembly V is supported by the annular spacer 4, whereby the stabilization of the opened and closed attitudes of the valve assembly V can be enhanced.

In this way, it is possible to establish both the stabilization of the opened and closed attitudes and the responsiveness of the valve assembly V to contribute to a long-term stabilization of the amount of fuel injected and an improvement in low fuel consumption in the engine.

The present invention is not limited to the above-described embodiment, and various modifications in design may be made without departing from the spirit and scope of the invention defined in the claim.

What is claimed is:

1. An electromagnetic fuel injection valve comprising:

a valve seat member having a valve seat at one end;

a valve housing coupled at one end thereof to the other end of said valve seat member;

a stationary core coupled to the other end of said valve housing; and a valve assembly comprising:

a movable core slidably accommodated in said valve housing so that said movable core is opposed to said stationary core, and a valve member connected to said movable core through a rod portion and adapted to cooperate with said valve seat, said valve housing being provided with a guide portion on which said valve assembly is axially slidably carried, said guide portion being disposed directly between a lowermost end of said stationary core and an uppermost end of said valve housing, said valve assembly having a high-hardness coating formed on an outer peripheral surface contacting with said guide portion, wherein said high-hardness coating is formed by depositing diamond-like carbon on the outer peripheral surface of said valve assembly by ion plating using an organic gas as a starting material, the surface roughness Rmax of said high-hardness coating being set in a range of 0.05 to 0.2 $\mu$m.

* * * * *